US010767456B2

(12) United States Patent
Konopczynski

(10) Patent No.: US 10,767,456 B2
(45) Date of Patent: Sep. 8, 2020

(54) METHODS AND SYSTEMS FOR RECOVERING OIL FROM SUBTERRANEAN RESERVOIRS

(71) Applicant: Swellfix UK Limited, Westhill, Aberdeenshire (GB)

(72) Inventor: Michael Robert Konopczynski, Houston, TX (US)

(73) Assignee: Swellfix UK Limited, Aberdeenshire (GB)

( * ) Notice: Subject to any disclaimer, the term of this patent is extended or adjusted under 35 U.S.C. 154(b) by 97 days.

(21) Appl. No.: 15/876,354

(22) Filed: Jan. 22, 2018

(65) Prior Publication Data

US 2019/0226308 A1 Jul. 25, 2019

(51) Int. Cl.

| | |
|---|---|
| ***E21B 43/16*** | (2006.01) |
| ***E21B 43/12*** | (2006.01) |
| ***E21B 43/14*** | (2006.01) |
| ***E21B 34/06*** | (2006.01) |
| ***E21B 17/10*** | (2006.01) |
| ***E21B 33/12*** | (2006.01) |
| ***E21B 33/138*** | (2006.01) |
| ***E21B 43/114*** | (2006.01) |

(Continued)

(52) U.S. Cl.

CPC ..... *E21B 43/16* (2013.01); *E21B 17/1035* (2013.01); *E21B 33/12* (2013.01); *E21B 33/138* (2013.01); *E21B 34/06* (2013.01); *E21B 43/114* (2013.01); *E21B 43/12* (2013.01); *E21B 43/14* (2013.01); *E21B 43/166* (2013.01); *E21B 43/26* (2013.01); *E21B 43/38* (2013.01)

(58) Field of Classification Search

CPC ..... E21B 43/12; E21B 43/16; E21B 43/34; E21B 43/38

See application file for complete search history.

(56) References Cited

U.S. PATENT DOCUMENTS

2013/0213652 A1 8/2013 Stalder
2013/0228337 A1* 9/2013 Dombrowski ..... E21B 43/17 166/308.1

(Continued)

OTHER PUBLICATIONS

International Search Report dated Mar. 18, 2019, issued in corresponding Application No. PCT/GB82019/050019.

(Continued)

*Primary Examiner* — Catherine Loikith

(74) *Attorney, Agent, or Firm* — Harness, Dickey & Pierce, P.L.C.

(57) ABSTRACT

A method and system for recovering oil from a subterranean reservoir. The method includes delivering an injection gas through an injection flow path into a plurality of regions of the reservoir via a plurality of outflow devices arranged along the injection flow path, producing oil from a plurality of regions of the subterranean reservoir via a production flow path with a plurality of inflow devices arranged along the production flow path, and restricting flow of the injection gas into the production flow path from the reservoir. The restricting of the flow in injection gas may be by choking the flow of the injection gas through at least one of the plurality of inflow devices such that the residence time of the injection gas within the subterranean reservoir is increased.

20 Claims, 8 Drawing Sheets

(51) Int. Cl.
*E21B 43/26* (2006.01)
*E21B 43/38* (2006.01)

(56) References Cited

U.S. PATENT DOCUMENTS

| | | | | |
|---|---|---|---|---|
| 2015/0096756 | A1* | 4/2015 | Sharma | E21B 43/24 166/306 |
| 2015/0369023 | A1 | 12/2015 | MacPhail et al. | |
| 2017/0030173 | A1 | 2/2017 | MacPhail et al. | |

OTHER PUBLICATIONS

Written Opinion of the International Searching Authority dated Mar. 18, 2019, issued in corresponding Application No. PCT/GB2019/050019.

"FloSure Bypass Valve", http://www.tendeka.com/technologies/inflow-control/flosure-bypass-valve/—retrived Jan. 22, 2018.

"FloSure AICD Screens & Subs", http://www.tendeka.com/technologies/inflow-control/flosure-aicd-screens/—retrived Jan. 22, 2018.

* cited by examiner

METHODS AND SYSTEMS FOR RECOVERING OIL FROM SUBTERRANEAN RESERVOIRS

FIELD

The present disclosure relates to methods and systems for recovering oil from subterranean reservoirs, in particular by providing an improved enhanced oil recovery method and system.

BACKGROUND

An increasing amount of oil and gas is originating from what are often referred to as "unconventional" subterranean oil reservoirs. "Shale reservoirs" are examples of such unconventional subterranean oil reservoirs. In unconventional oil reservoirs such as shale reservoirs, the oil recovery efficiency may be comparatively low due to the low permeability of the formation. This has resulted in the development of enhanced oil recovery schemes to stimulate production and increase recovery efficiency. It is desirable for such schemes to maximise the oil recovery efficiency.

An enhanced oil recovery scheme may involve the injection of an injection gas, e.g. hydrocarbon gas, carbon dioxide or steam, into the reservoir. The injection gas may be injected into fractures which have been induced in the formation surrounding the well, for example in the case of a fracture stimulated horizontal well. The presence of the injection gas maintains pressure in the reservoir and increases the mobility of the oil within the reservoir such that it more readily enters the well and the production conduit.

In some embodiments injection gas is injected into the reservoir via a first well and oil is produced in a second, adjacent, well. In other embodiments, a single well may be used to inject gas into the reservoir in a first phase and then produce oil in a second phase; this method is often referred to as a "huff and puff" process.

In order to maximise oil recovery efficiency, it is often desirable to inject the injection gas into the reservoir at a high pressure and then provide a period during which the injection gas diffuses within the reservoir where it can combine with the interstitial oil. This period if often referred to as a "soak" period and may last days, weeks or months. After the "soak" period, the well is reopened and the oil and gas enters the production flow path from the reservoir.

The production of oil from an unconventional oil reservoir during enhanced oil recovery schemes is generally governed and facilitated by the expansion of the oil within the formation as pressure is reduced in the wellbore and fractures, causing the oil to "seep" into the wellbore. The injection gas is designed to interact with the oil within the low-permeability formation and diffusion allows the oil to migrate into the well, and thus be produced, once the production phase begins.

SUMMARY

It has been found that keeping the gas in the reservoir for longer periods of time, and at higher pressures, can greatly affect the recovery efficiency that can be achieved. In general, the longer the soak period and thus the longer the residence time of the injection gas within the reservoir, the more diffusion has occurred in the reservoir. Increased diffusion can lead to increased recovery efficiency. Increased pressure in the well also favourably affects recovery efficiency as it accelerates the diffusion process.

As the well may be effectively shut off and thus may not produce oil during the soak period, there can be a trade-off between maximising residence time of injection gas in the reservoir to maximise diffusion and minimising the time during which the well is not producing.

The present disclosure allows the residence time of the injection gas to be increased, and at higher pressures, while minimising the time during which the well is not producing.

According to the present disclosure is a method for recovering oil from a subterranean reservoir.

The method may comprise delivering an injection gas through an injection flow path. The injection gas may be delivered into a plurality of regions of the reservoir. The injection gas may be delivered via a plurality of outflow devices arranged (e.g. axially) along the injection flow path.

The method may further comprise producing oil from a plurality of regions of the subterranean reservoir via a production flow path with a plurality of inflow devices arranged (e.g. axially) along the production flow path.

The method may further comprise restricting flow of the injection gas into the production flow path from the reservoir. The flow of the injection gas into the production flow path from the reservoir may be restricted by choking the flow of the injection gas through at least one of the plurality of inflow devices. Restricting flow of the injection gas into the production flow path may increase the residence time of the injection gas within the subterranean reservoir.

Further according to the present disclosure is a system for recovering oil from a subterranean reservoir.

The system may comprise an injection flow path for delivering injection gas into a plurality of regions of the subterranean reservoir. The injection flow path may comprise a plurality of outflow devices arranged (e.g. axially) along the injection flow path.

The system may further comprise a production flow path for producing oil from a plurality of regions of the subterranean reservoir. The production flow path may comprise a plurality of inflow devices arranged (e.g. axially) along the production flow path.

At least one of the plurality of inflow devices may be configured to choke the flow of the injection gas into the production flow path from the reservoir. Choking the flow of the injection gas into the production flow path may increase the residence time of the injection gas within the subterranean reservoir.

Further according to the present disclosure is a completion for use in a well.

The completion may comprise an injection flow path for delivering injection gas into a subterranean reservoir. The injection flow path may comprise a plurality of outflow devices configured to permit outflow of the injection gas into the reservoir.

The completion may further comprise a production flow path for producing oil from the subterranean reservoir.

The production flow path may comprise a plurality of inflow devices configured to permit inflow of oil into the production flow path from the reservoir while choking the flow of injection gas into the production flow path from the reservoir. This may result in the residence time of the injection gas within the subterranean reservoir being increased.

The methods and systems of the present disclosure are for use with subterranean reservoirs. Examples may include unconventional reservoirs such as shale reservoirs.

The methods and systems may, however, be for use with other types of reservoirs.

In the present disclosure it is to be understood that where features are described with reference to one of, "at least one of" or "a"—for example "at least one of the plurality of inflow/outflow devices"—this is to be interpreted to disclose "a", "some of" and "each". For example, where it is said that "at least one of the plurality of inflow/outflow devices" has a certain property, this is to be understood to also disclose "some of the plurality of inflow/outflow devices" and "each of the plurality of inflow/outflow devices". Equally, where a feature is described with reference to "some", "a plurality of", "all of", or "each"—for example "all of the inflow devices", or "a plurality of the outflow devices", have a certain property—this is to be interpreted to also disclose "a", "one of" or "at least one of" the outflow devices having the certain property.

The method of recovering oil from a subterranean reservoir may comprise drilling a wellbore into a subterranean reservoir. Typically, directional drilling may be used to provide a horizontal well. The well may be open hole or lined with casing cemented in place. A plurality of wells may be drilled into the reservoir.

Once the wellbore has been created, the method may comprise creating fractures in the reservoir proximal to the well. The fractures may radiate from the well. When the well has a cemented liner the fractures may be created using a "plug and perf" method which utilises a plug and a perforation gun which are located at the desired depth. When the well is an open hole well, a multi-zone "ball drop" fracture sleeve system may be utilised.

Once the fractures have been created, the equipment for creating the fractures may be removed from the well and the well may be cleaned up.

The method for recovering oil from a subterranean reservoir may comprise deploying a system for recovering oil from a subterranean reservoir into the well.

It should be noted that the system for recovering oil from a subterranean reservoir may be an apparatus or assembly for recovering oil from a subterranean reservoir. The system may be, or comprise, a completion apparatus or assembly.

The system may comprise a tubular internal liner. The liner may be suspended from a production packer or liner hanger/packer in order to isolate the formation from the upper wellbore. The method may comprise isolating the formation from the upper wellbore, for example by using a liner hanger/packer.

The liner may contain or provide the injection flow path. The liner may contain or provide the production flow path. In certain examples, the liner may comprise the injection flow path and the production flow path. The liner may provide the injection flow path and the production flow path—i.e. the liner may transport the injection gas from the surface to the outflow devices and the oil from the inflow devices to the surface.

The flow paths may comprise independent tubing and flow control components within the liner, or the liner itself may be the tubing for one or both flow paths. The liner may comprise a "tube-in-a-tube" arrangement, whereby a first one of the flow paths is provided in a tube concentrically arranged within the liner and the second one of the flow paths is provided by the annulus between the liner and the tubing of the first flow path.

The method may further comprise separating or dividing the well (and thus reservoir) into a plurality of axially-isolated regions.

The system may comprise devices for separating the system into the plurality of regions (e.g. packers). The plurality of regions may be hydraulically isolated from each other. Each region of the wellbore may correspond to a fracture or plurality of fractures in the formation. The system may comprise a central liner with a plurality of swell packers, mechanical packers, seal stacks and seal bores located at chosen axial locations to isolate the regions of the wellbore and reservoir.

The term region may refer to a portion of the reservoir or well which is separated from other regions or portions of the reservoir or well by one of the separation systems described above. As such, in some examples, a first region may have different operating characteristics to a second region—for example a different injection gas delivery pressure, or a different oil production pressure.

Once the completion apparatus is installed, the method may comprise an initial production phase during which oil is produced from a plurality of regions of the subterranean reservoir via the production flow path using the plurality of inflow devices.

The method may comprise producing oil from a plurality of regions of the subterranean reservoir, which may comprise an initial production phase before delivering injection gas and a subsequent production phase after delivering injection gas.

After a certain period of time during the initial production phase, the oil production may decrease as the pressure in the reservoir proximal to the wellbore and fractures reduces.

The method may comprise determining and setting a pressure value for when an initial production phase is to cease and then producing oil during an initial production phase until the pressure in the reservoir proximal to the wellbore reaches a pre-determined level—(e.g. the pre-set threshold value). The system may comprise a pressure sensing device for determining when the pressure in the reservoir proximal to the wellbore reaches the pre-determined level.

Once any initial production phase is complete, the method may comprise delivering an injection gas into the reservoir via the outflow devices. The injection flow path may comprise at least one outflow device in each of a plurality of regions of the subterranean reservoir. Outflow devices may be located in each of the regions of the well, or only some of the regions of the well—for example every other region.

The method may comprise delivering an injection gas at a first pressure in a first region of the reservoir and at a second pressure in a second region of the reservoir. The method may comprise varying the pressure at which the injection gas is delivered across the plurality of regions of the reservoir in order to balance the injection.

A first one of the plurality of outflow devices, located in a first region of the reservoir, may be configured to provide a first pressure drop across the device and a second one of the plurality of outflow devices, located in a second region of the reservoir, may be configured to provide a second pressure drop. The pressure drops may be rate dependent. The first and second pressure drops may be different in order to facilitate the injection gas being delivered at different pressures to different regions of the reservoir. This may facilitate adapting the injection gas delivery in order to suit the geological properties of each specific region.

The method may comprise delivering an injection gas at a first rate in a first region of the reservoir and at a second rate in a second region of the reservoir. The method may comprise varying the rate at which the injection gas is delivered across the plurality of regions of the reservoir in order to balance injection.

A first one of the plurality of outflow devices, located in a first region of the reservoir, may be configured to provide a first fluid delivery rate and a second one of the plurality of outflow devices, located in a second region of the reservoir, may be configured to provide a second fluid delivery rate. The first and second delivery rates may be different in order to facilitate the injection gas being delivered at different rates to different regions of the reservoir. This may facilitate adapting the injection gas delivery in order to suit the geological properties of each specific region.

At least one of the outflow devices may be configured to require a certain pressure differential across it in order to permit flow through the outflow device. As such, the pressure within the injection flow path may need to reach a threshold value, defined by the outflow devices, before the injection gas can flow through the outflow device into the reservoir.

At least one of the outflow devices may be an Inflow Control Device (ICD). The ICD may be arranged to control outflow rather than inflow. Outflow devices with different flow restrictions may be employed in different regions of the well. The outflow devices may thus be configured to control the flow therethrough in order to balance the injection gas delivered to the reservoir across the plurality of regions to suit the geological properties of the specific regions.

At least one of the outflow devices may be configured to prevent fluid entering the injection flow path from the reservoir (i.e. inflow, via the outflow device). The method may therefore comprise preventing fluid from entering the injection flow path via the outflow devices. The fluid may be liquid and/or gas. The fluid may be CO2, hydrocarbon gas, nitrogen, steam, oil or other fluids known to be used or encountered downhole. The injection fluid may be miscible, partially miscible or immiscible with the oil.

At least one of the outflow devices may be configured to act as a check valve for the inflow direction, i.e. for fluid trying to flow into the injection flow path from the reservoir, and thus may check such flow.

An example of a suitable ICD for use as an outflow device may be the Tendeka FloSure Bypass Valve™ (http://www-.tendeka.com/technologies/inflow-control/flosure-bypass-valve/), although it is to be understood that this is purely an example of a suitable component and the present disclosure is not to be limited as such; many other suitable examples exist.

In some examples, the method may comprise a soak period after the injection fluid is delivered to the reservoir and before oil is produced from the reservoir.

The method may comprise stopping all fluid flow in the injection flow path and/or the production flow path to control the residence time of the injection gas within the subterranean reservoir. This may be done by balancing the pressure in the injection flow path and/or production flow path with the pressure in the reservoir.

The system may be configured to stop fluid flow in the injection flow path. The system may be configured to stop fluid flow in the production flow path. Stopping flow in the injection and/or production flow path may control the residence time of the injection gas within the subterranean reservoir.

The term fluid may refer to liquid and/or gas. As such, the fluid as used herein may, for example, refer to the injection gas (e.g. CO2, hydrocarbon gas, nitrogen, steam or any other gas known to be suitable for such use) or oil, or other fluids known to be used or encountered downhole.

Once the injection gas has been delivered to the reservoir, the method may comprise a soak period, during which injection and production are stopped and the injection gas is left to diffuse through the oil within the reservoir. The injection gas may diffuse into the reservoir and interact with the oil. The injection gas may form a solution with the oil. When in solution with the oil, the injection gas may facilitate the expansion of the oil through the reservoir. This expansion of the oil using the injection gas may be the mechanism by which the oil is produced once the soak period has ended and production begins.

In order to provide the soak period, the production flow path may be shut so as to prevent flow therethrough. The system may comprise a closure device configured to close the production flow path on the surface and preventing any fluid flow therethrough.

The injection flow path may still be open, such that injection gas can be gradually delivered to the reservoir during the soak period. Alternatively, the injection flow path may also be shut so as to prevent flow therethrough. The system may therefore also comprise a closure device configured to close the injection flow path.

The soak period, during which there may be no flow through the production flow path and optionally no flow through the injection flow path, may last hours, days, weeks or even months, depending on the geological properties of the reservoir and the thermodynamic and chemical properties of the oil.

Providing a soak period may maximise oil recovering efficiency once production begins.

In some examples, the method may comprise producing oil immediately after delivering the injection gas. In these examples, no soak period is provided and oil is produced from the reservoir immediately after the injection gas is delivered to the reservoir. The method may therefore comprise opening the injection flow path such that injection gas is delivered to the reservoir while the production flow path is closed; and then opening the production flow path—for example once the injection gas has been delivered. The injection flow path may not need to be closed while oil is produced, as the outflow device may prevent fluid from entering the injection flow path from the reservoir.

In other examples of the method, delivering an injection gas through an injection flow path, producing oil from a plurality of regions of the subterranean reservoir and restricting flow of the injection gas into the production flow path may be undertaken simultaneously.

The system may be configured to simultaneously deliver injection gas through the injection flow path; produce oil through the production flow path; and choke the flow of injection gas into the production flow path.

During simultaneous delivery of injection gas and production of oil, the system may be configured to have the injection flow path and production flow path open simultaneously. Having simultaneous injection and production may ensure that a well does not have any significant downtime during which it is not producing oil. In order to have simultaneous injection and production the injection flow path and production flow path may need to be independent. The liner may contain two independent flow paths therein.

The method may comprise providing a single well, two wells or a plurality of wells. The system may comprise a single well, two wells, or a plurality of wells.

In some examples, the system may comprise a (single) well. The injection flow path and the production flow path may (both) be in a single well. The injection flow path and the production flow path may be provided as part of a single completion apparatus for use in a single well.

A single conduit within the well may provide both the injection flow path and production flow path. The two flow paths may therefore comprise a single conduit. It may, therefore, be the case that the injection flow path comprises a conduit and outflow devices and the production flow path comprises the same conduit and inflow devices.

The system may comprise an internal liner running along the well and both of the flow paths may be arranged within the internal liner, with suitable connections, valves and bypasses to allow the outflow devices and inflow devices to provide an interface between their respective flow paths and the reservoir.

When an injection and production flow path is provided in a single well, the outflow devices and inflow devices may be arranged in an alternating manner, wherein an inflow review is arranged between every two outflow devices (and optionally vice versa). A region—or every region—of the reservoir may have at least one outflow device and at least one inflow device.

Alternatively, in some examples, the outflow and inflow devices may be arranged in groups, such that a plurality of outflow devices are arranged in a first region—with no inflow devices—and a plurality of inflow devices are arranged in a second region—with no outflow devices. In this arrangement, a region of the well may have only outflow or inflow devices—not both. A first region may have only outflow devices and thus define an outflow region where fluid only flows out of the well; and a second region may have only inflow devices and thus define an inflow region where fluid only flows in to the well, from the reservoir.

It is to be understood that where it is stated that injection gas is delivered to "a plurality of regions of the reservoir" and oil is produced from "a plurality of regions of the reservoir", the plurality of regions for the injection and production may be the same plurality of regions (i.e. injection gas is delivered to the same regions from which oil is produced), or a different plurality of regions (i.e. injection gas is delivered to regions which are different to those from which oil is produced).

In some examples, the system may comprise a first well and a second well. The injection flow path may be in a first well and the production flow path may be in a second well.

The system may comprise a first completion apparatus for use in a first well and a second completion apparatus for use in a second well. The second well may be located adjacent to the first well. The first completion apparatus may comprise the injection flow path and the second completion apparatus may comprise the production flow path.

When a well is used for only one of delivering injection gas or producing oil, the internal liner may provide or comprise the respective flow path.

When two wells are used—one for injection and one for production, the wells may be arranged in close proximity to one another.

The method and considerations as to whether to provide a soak period, or whether to inject and produce immediately sequentially, or simultaneously, may be unaffected, regardless of whether a single well provides only one or both of an injection and production flow path.

Oil may be produced from a plurality of regions of the reservoir through the inflow devices arranged along the production flow path. The production flow path may comprise at least one inflow device in each of a plurality of regions of the subterranean reservoir.

The method may comprise producing oil from a first region of the reservoir at a first pressure using a first inflow device or inflow devices; and from a second region of the reservoir at a second pressure using a second inflow device or inflow devices. The method may comprise varying the pressure of the plurality of regions from which oil is produced in order to balance production.

A first one of the plurality of inflow devices, located in a first region of the reservoir, may be configured to define a first (e.g, rate dependent) pressure drop across the device. A second one of the plurality of inflow devices, located in a second region of the reservoir, may be configured to define a second (e.g. rate dependent) pressure drop across the device. The first and second pressure drops may be different in order to balance production across the well.

The method may comprise producing oil at a first rate in a first region of the reservoir and at a second rate in a second region of the reservoir. The method may comprise varying the rate at which oil is produced across the plurality of regions.

A first one of the plurality of inflow devices, located in a first region of the reservoir, may be configured to produce oil at a first rate, i.e., may define a first flow rate. A second one of the plurality of inflow devices, located in a second region of the reservoir, may be configured to produce oil at a second rate, i.e., may define a second flow rate. The first and second rates may be different to balance production across the well.

At least one of the inflow devices may be configured to prevent fluid entering the reservoir via the production flow path (i.e. outflow, via the inflow device). The method may therefore comprise preventing fluid (e.g. injection gas) from entering the reservoir from the production flow path.

The term fluid may refer to liquid and/or gas. As such, the fluid as used herein may, for example, refer to the injection gas (e.g. CO2, hydrocarbon gas, nitrogen, steam or any other gas known to be suitable for such use) or oil, or other fluids known to be used or encountered downhole. The fluid may be miscible, partially miscible or immiscible with the oil.

At least one of the inflow devices may be configured to act as a check valve for the outflow direction, i,e, for fluid trying to flow into the reservoir from the production flow path.

During production, the flow of injection gas into the production flow path may be restricted. This may be achieved by the plurality of inflow devices choking the flow of injection gas into the production flow path.

The flow of injection gas into the production flow path may be restricted at the same time as oil is produced via the production flow path.

This may not occur during the initial production phase (i.e. before injection gas is delivered into the reservoir).

The flow of injection gas may be choked through at least one of the plurality of inflow devices while oil is produced through at least one of the plurality of inflow devices.

At least one of the plurality of inflow devices may be configured to choke the flow of the injection gas into the production flow path in a first region of the reservoir while oil is produced from a second region of the reservoir (through a further inflow device) via the production flow path.

The flow of injection gas may be restricted by choking the flow of the injection gas at a first one of the plurality of inflow devices while producing oil at a second one of the plurality of inflow devices. The flow of injection gas may be actively choked by the inflow device.

The production flow path being configured to simultaneously produce oil while choking the inflow of injection gas helps maintain injection gas in the reservoir while producing oil. In systems not according to the disclosure, injection gas is not choked and thus it enters the production flow path and leaves the reservoir at a much higher rate, thus reducing the amount of injection gas in the reservoir and the average residence time of the injection gas. The average pressure in the reservoir is higher in examples of the present disclosure compared to existing systems.

As the present system increases the average residence time (and reservoir pressure) of the injection gas compared to a system which does not provide injection gas choking during production, recovery efficiency may be increased. An operator can recover more oil for a given soak period, or a shorter soak period (during which there is no production) may achieve a given recovery efficiency.

Restricting flow of the injection gas into the production flow path may comprise selectively choking the flow of fluid through at least one of the plurality of inflow devices such that the flow of injection gas through the at least one of the plurality of inflow devices is choked more than the flow of oil.

At least one of the plurality of inflow devices may be configured to selectively choke the flow of fluid such that the flow of injection gas through the inflow device is choked more than the flow of oil. The flow of oil may not be choked.

The inflow devices may be configured to preferentially allow oil to flowtherethrough rather than injection gas.

The inflow devices (or the production flow path) may be configured such that injection gas can enter the production flow path from the reservoir at a first maximum flow rate and oil can enter the production flow path from the reservoir at a second maximum flow rate, wherein the second maximum flow rate is higher than the first maximum flow rate.

The flow of fluid through at least one of the plurality of inflow devices may be selectively choked based on the viscosity of the fluid.

At least one of the plurality of inflow devices may be configured to selectively choke the flow of fluid therethrough based on at least one of the viscosity of the fluid and the density of the fluid. The flow of fluid which is choked may be fluid flowing in an inflow direction.

The inflow devices may be configured to selectively restrict the flow of fluid through the device depending on the viscosity of the fluid. The inflow devices may be configured to restrict the flow of a fluid with a first viscosity more than a fluid with a second, higher, viscosity.

The inflow devices may be configured to selectively restrict the flow of fluid through the device depending on the density of the fluid. The inflow devices may be configured to restrict the flow of a fluid with a first density more than a fluid with a second, higher, density.

Alternatively, the inflow devices may be configured to selectively restrict the flow of fluid through the device depending on both the density and the viscosity of the fluid.

An inflow device may be configured to define a first pressure drop and/or flow rate across/through the device when a first fluid (e.g. oil) is flowing through the device and a second pressure drop and/or flow rate across/through the device when a second fluid (e.g. injection gas) is flowing through the device.

A first inflow device in a first region of the reservoir may be configured to define a first pressure drop and/or flow rate across/through the device when a first fluid (e.g. oil) is flowing through the device and a second pressure drop and/or flow rate across/through the device when a second fluid (e.g. injection gas) is flowing through the device: a second inflow device in a second region of the reservoir may be configured to define a third pressure drop and/or flow rate across/through the device when a first fluid (e.g. oil) is flowing through the device and a fourth pressure drop and/or flow rate across/through the device when a second fluid (e.g. injection gas) is flowing through the device. In this manner, injection gas may be actively choked by the inflow devices while balancing production across the well.

The pressure drops may be rate dependent.

At least one of the inflow devices may be configured to require a certain pressure differential across it in order to permit flow through the inflow device. As such, the pressure within the reservoir (and hence annulus of the well) may need to be at least a threshold value, defined by the inflow devices, before the oil can be produced through the inflow device.

At least one of the inflow devices may be an Autonomous Inflow Control Device (AICD). The AICD may be configured to selectively and actively control the flow of fluid into the production flow path. This may be used to control production rates across the well and to increase injection gas residence time in the reservoir, so as to maximise oil recovery efficiency.

An example of a suitable AICD for use as an outflow device may be the Tendeka FloSure™ AICD (http://www-.tendeka.com/technologies/inflow-control/flosure-aicd-screens/), although it is to be understood that this is purely an example of a suitable component and the present disclosure is not to be limited as such; many other suitable examples exist.

The inflow devices and outflow devices may be separate, independent devices.

Alternatively, the inflow and outflow devices may be the same devices. The inflow and outflow devices may be combined as a single set of devices, each of which provides the functions of an inflow and an outflow device.

At least one of the inflow devices may also be an outflow device.

In some examples, the method and/or system may comprise a plurality of flow devices, each flow device acting as an outflow device and an inflow device.

In such embodiments, both the injection flow path and the production flow path may comprise the flow devices.

The flow devices may be configured to act as the outflow devices described herein when fluid is flowing into the reservoir from one of the flow paths (i.e. in an outflow direction). As such, any features and comments described herein with reference to the outflow devices apply, mutatis mutandis, to the flow devices when flow is flowing outward—that is into the reservoir from one of the flow paths (e.g. the injection flow path).

The flow devices may be configured to act as the inflow devices described herein when fluid is flowing from the reservoir into one of the flow paths (i.e. in an inflow direction). As such, any features and comments described herein with reference to the inflow devices apply, mutatis mutandis, to the flow devices when flow is flowing inward—that is from the reservoir into one of the flow paths (e.g. the production flow path).

Certain AICDs may be suitable for use as a flow device which is both the inflow and outflow device. The flow device may be configured to allow unrestricted flow in an outflow direction and selectively restrict flow in an inflow direction (as described in relation to the inflow device).

When an example comprises flow devices which may act as both inflow and outflow devices, the injection flow path and production flow path may be provided by the same components (e.g. tubing).

According to the disclosure is a method for recovering oil from a subterranean reservoir, the method comprising: delivering an injection gas through an injection flow path into a plurality of regions of the subterranean reservoir via a plurality of flow devices arranged along the injection flow path; producing oil from a plurality of regions of the reservoir via a production flow path with a plurality of the flow devices arranged along the production flow path; and restricting flow of the injection gas into the production flow path from the reservoir by choking the flow of the injection gas through at least one of the plurality of flow devices such that the residence time of the injection gas within the reservoir is increased.

The flow of the injection gas from the reservoir into the production flow path through at least one of the plurality of flow devices may be choked, while oil is produced through at least one of the plurality of flow devices.

Restricting flow of the injection gas into the production flow path may comprise selectively choking the flow of fluid from the reservoir into the production (and/or injection) path through at least one of the plurality of flow devices such that the flow of injection gas from the reservoir into a flow path through the at least one of the plurality of flow devices is choked more than the flow of oil.

The flow of fluid through the at least one of the plurality of flow devices in a direction from the reservoir into one of the flow paths may be selectively choked based on at least one of the viscosity of the fluid and the density of the fluid.

Further according to the disclosure is a system for recovering oil from a subterranean reservoir; the system may comprise: an injection flow path for delivering injection gas into a plurality of regions of a subterranean reservoir; wherein the injection flow path comprises a plurality of flow devices arranged along the injection flow path; a production flow path for producing oil from a plurality of regions of the subterranean reservoir; wherein the production flow path comprises a plurality the flow devices arranged along the production flow path; wherein at least one of the plurality of flow devices is configured to choke the flow of the injection gas into the production flow path from the reservoir such that the residence time of the injection gas within the subterranean reservoir is increased.

The plurality of flow devices may be configured to allow unrestricted flow in an outward direction, from the injection flow path into the reservoir.

The plurality of flow devices may be configured to choke the flow of the injection gas into the production flow path in a first region of the reservoir while oil is produced from a second region of the reservoir via the production flow path.

At least one of the plurality of flow devices may be configured to selectively choke the flow of fluid such that the flow of injection gas from the reservoir into the production (and/or injection) flow path, through the flow device, is choked more than the flow of oil.

At least one of the plurality of flow devices may be configured to selectively choke the flow of fluid therethrough based on at least one of the viscosity of the fluid and the density of the fluid.

The injection flow path and production flow path may be provided as part of a single completion apparatus for use in a single well.

BRIEF DESCRIPTION OF DRAWINGS

Examples of the disclosure will now be described, purely by way of example, with reference to the following figures, in which:

FIG. 1 schematically illustrates a system 10 for recovering oil from a subterranean reservoir according to the disclosure.

Figure 1:
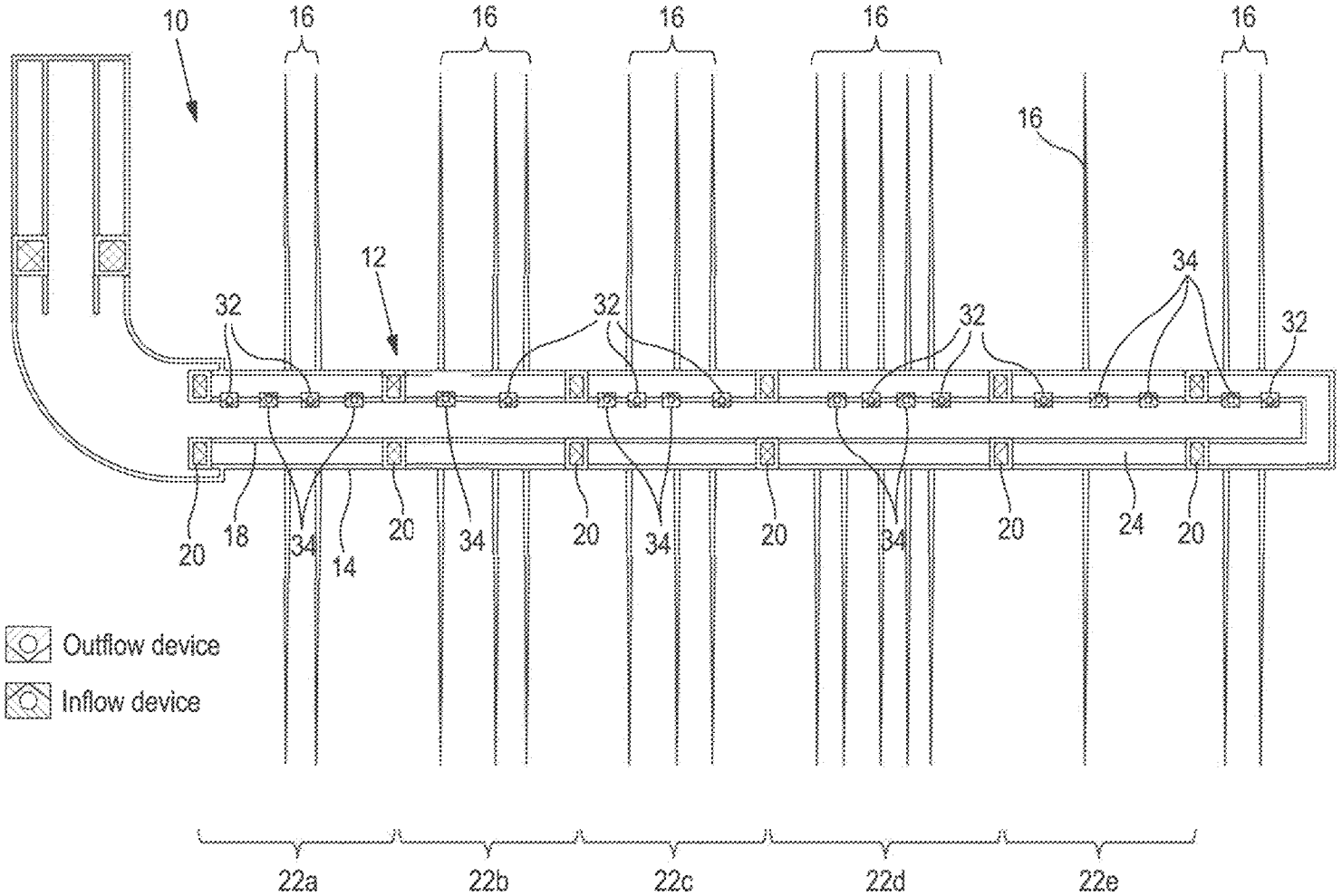
FIG. 1 is a schematic representation of a system according to the disclosure.

The portion of the system 10 in a well 12 depicted in FIG. 1 is below ground in a subterranean reservoir. The reservoir is an unconventional oil reservoir—for example a shale reservoir. Accordingly, the permeability of the formation is very low which can lead to low oil recovery efficiency. As such, an improved enhanced oil recovery technique according to the present disclosure may be employed.

The horizontal well 12 has been drilled using a directional drill. Once the drilling equipment is removed from the well 12, the bore has been lined with casing 14 which has been cemented in place. Fractures 16 are created in the reservoir proximal and radiating out from the well 12, for example by using a "plug and perf" technique. The fractures 16 are introduced to aid in oil production.

Once the equipment for creating the fractures 16 is removed from the well 12, the system 10 for recovering oil—that is, the completion—is installed in the well 12. The system 10 is according to this disclosure.

The system 10 comprises a liner 18 which comprises tubing running down the centre of the well 11. The liner 18 is concentrically arranged with the casing 14. Swell packers 20 are installed at various locations along the length of the well 12 in the annulus between the liner 18 and casing 14. The swell packers 20 are set to separate the well into a plurality of regions 22*a-e*. Each of the regions 22 is isolated from its neighbours and has access to a corresponding region of the reservoir such that oil from the corresponding region of the reservoir can enter the annulus 24 through holes/perforations in the casing 14 and from there enter the liner 18 via inflow devices 34 (discussed below).

Fluids may be transported between the liner 18 and the surface via further liners and tubing arranged in the vertical part of the well.

Figure 3:
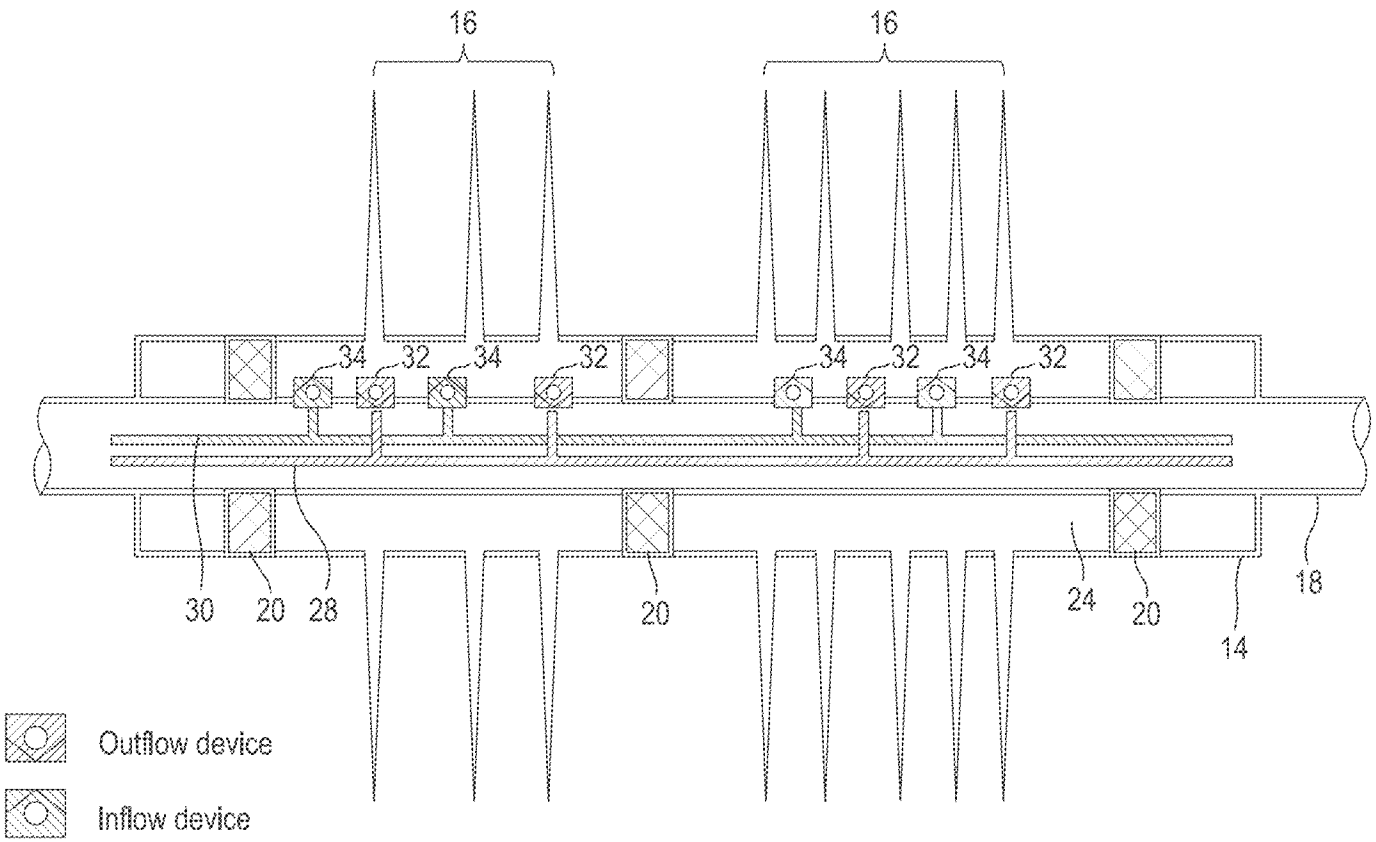
FIG. 3 is a schematic representation of a section of the system of FIG. 1.
Figure 4:
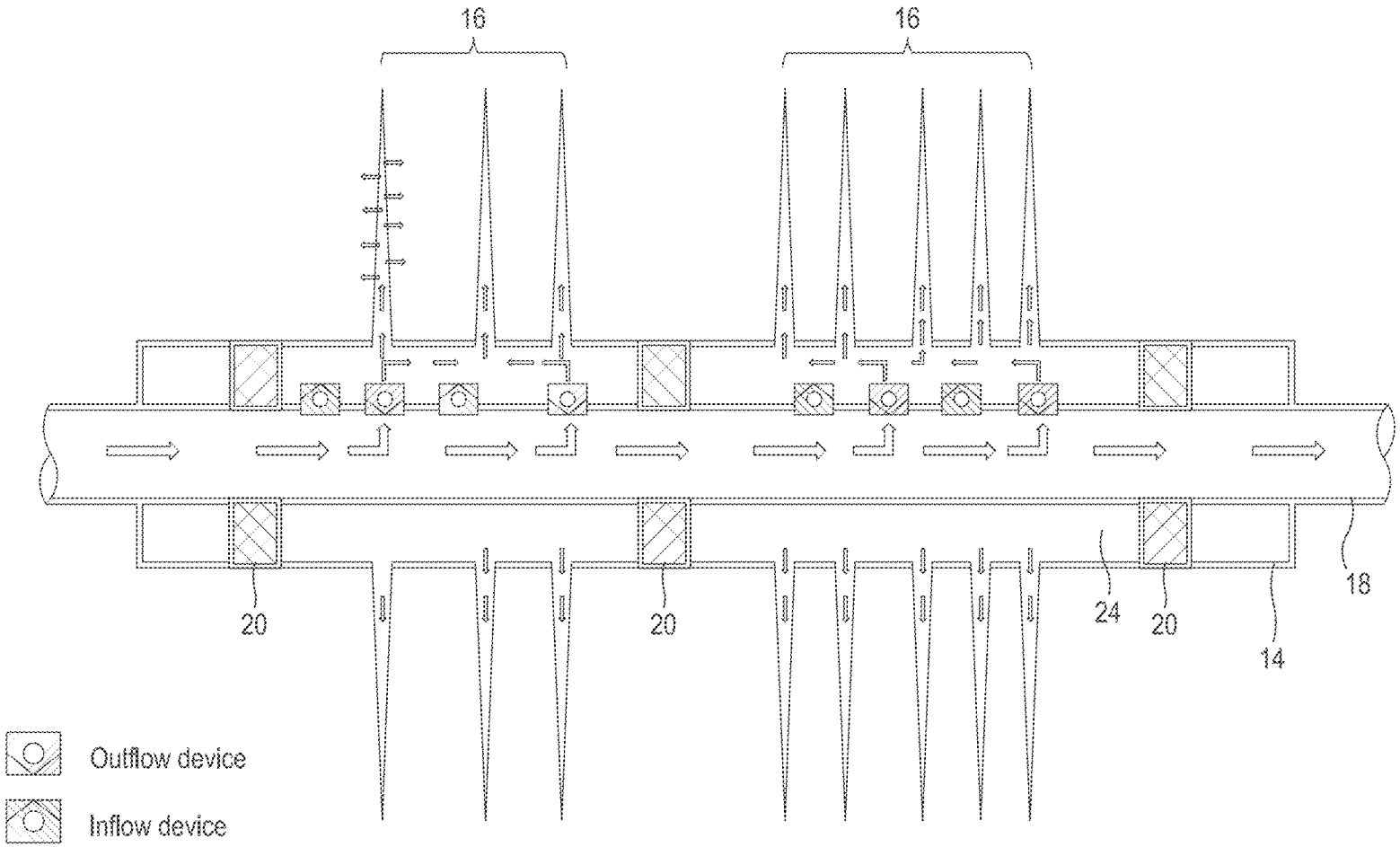
FIG. 4 is a schematic representation of the system of FIG. 3 during use.
Figure 5:
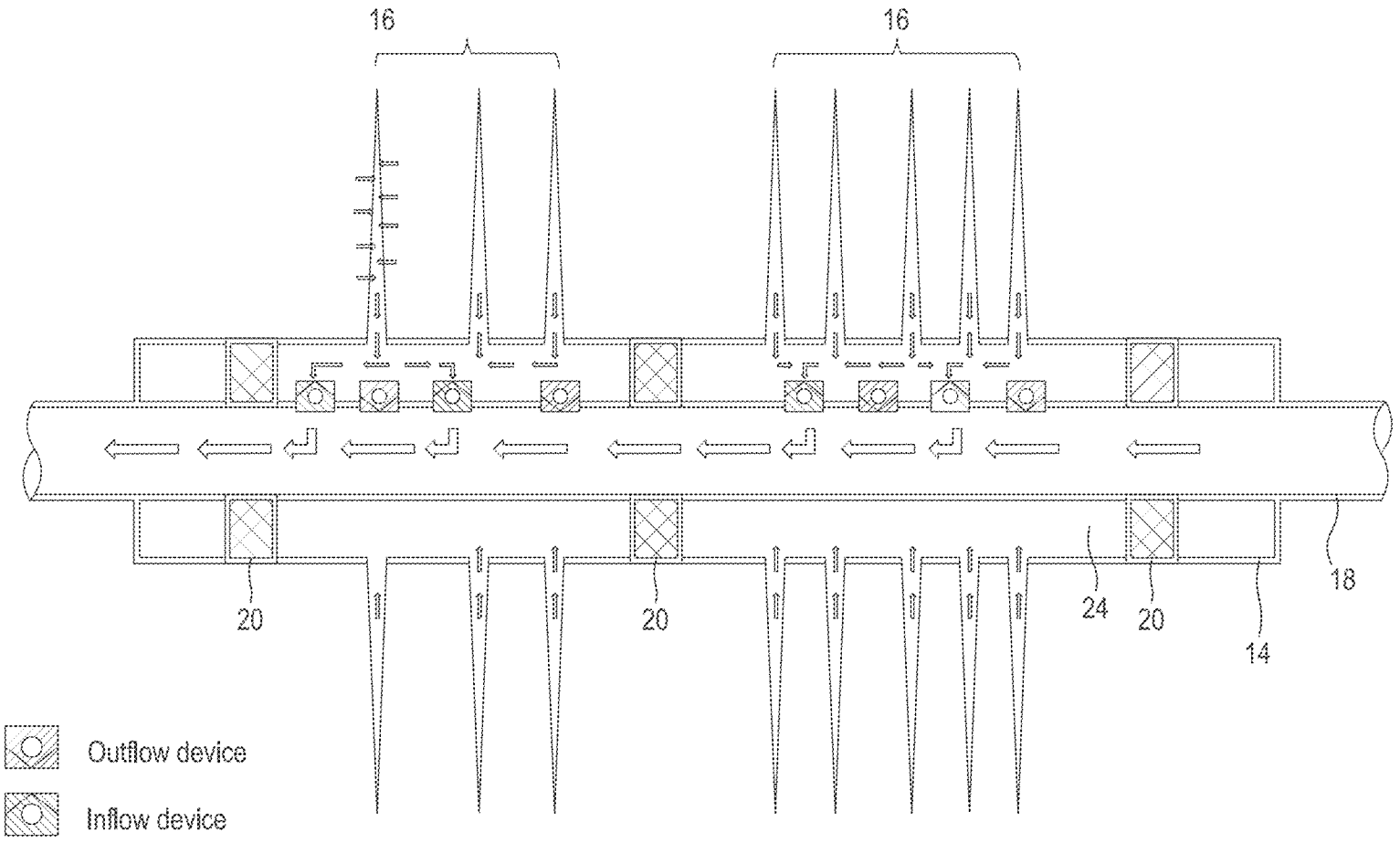
FIG. 5 is a schematic representation of the system of FIG. 3 during use.

The liner 18 comprises or provides two flow paths—an injection flow path 28 and a production flow path 30. FIG. 3 schematically illustrates the injection flow path 28 and the production flow path 30 connected to their respective flow devices. FIGS. 4 and 5 schematically show flow through the injection flow path 28 and production flow path 30, respectively.

The injection flow path 28 is configured to deliver injection gas into a plurality of regions 22 of the reservoir in order to increase oil recovery efficiency. The injection flow path 28 comprises a plurality of outflow devices 32 which are located in the interface of the liner 18 and annulus 24. The outflow devices 32 are arranged axially along the injection flow path 28 and hence the liner 18.

In some embodiments, the injection flow path 28 may comprise tubing (not shown) running inside the liner 18.

The injection flow path 28 and outflow devices 32 are configured to deliver an injection gas into the reservoir. Injection gas is delivered from the surface, through the liner 18, out of outflow devices 32 into the annulus 24 and from the annulus 24 into the regions of the reservoir in which the outflow devices 32 are located.

The outflow devices 32 of a region control the characteristics (pressure, flow rate . . . ) of the injection gas output by the injection flow path 28 in that region. In the present embodiment, the outflow devices 32 are inflow control devices (ICDs), albeit arranged to control outflow, rather than inflow. The outflow devices 32 are configured to define a rate dependent pressure drop when fluid flows through them.

The outflow devices 32 in each region 22 are configured to be suited to the geological properties of the formation in that region. As such, the pressure drop and/or maximum flow rate defined by the outflow devices 32 in a first region 22*a* of the reservoir are different to those in a second region 22*b* of the reservoir, since the geological properties of the formation in the two regions 22*a*, 22*b* vary.

The outflow devices 32 act as a check valve preventing fluid flow from the reservoir into the injection flow path 28 (i.e. inflowing fluid). Accordingly, no fluid can enter the injection flow path 28 from the reservoir via the outflow devices.

The production flow path 30 is configured to receive oil from the reservoir and transport it to the surface. The production flow path 30 comprises a plurality of inflow devices 34 which are located in the interface of the liner 18 and the annulus 24. The inflow devices 34 are arranged axially along the production flow path 30 and hence the liner 18.

In some embodiments, the production flow path 30 may comprise tubing (not shown) running inside the liner 18.

The production flow path 30 and inflow devices 34 are configured to receive and deliver oil to the surface. Oil from the reservoir enters the annulus 24 (often via the fractures 16) and enters the production flow path 30 via inflow devices 34. Oil then travels up the production flow path 30 to the surface.

Each of the inflow devices 34 is configured to selectively choke the flow of fluid through the device 34 such that injection gas flows through the device 34 less readily (at a slower rate) than oil. As such, each of the inflow devices 34 acts to prevent injection gas from leaving the reservoir via the production flow path and thus the average residence time and pressure of the injection gas in the reservoir is increased. This acts to increase the recovery efficiency without further well intervention.

The inflow devices 34 of the embodiment of FIG. 1 are autonomous inflow control devices (AICDs). The AICDs of FIG. 1 use the viscosity of the fluid flowing through them to adapt the flow rate—high viscosity fluids (e.g. oil) have a much higher flow rate than low viscosity fluids (e.g. injection gas).

The inflow devices 34 act as check valves for outflowing fluid—i.e. fluid flow into the reservoir from the production flow path 30 via inflow devices 34. Accordingly, fluid can only flow through the inflow devices 34 from the reservoir into the production flow path 30, not the other direction.

Figure 2:
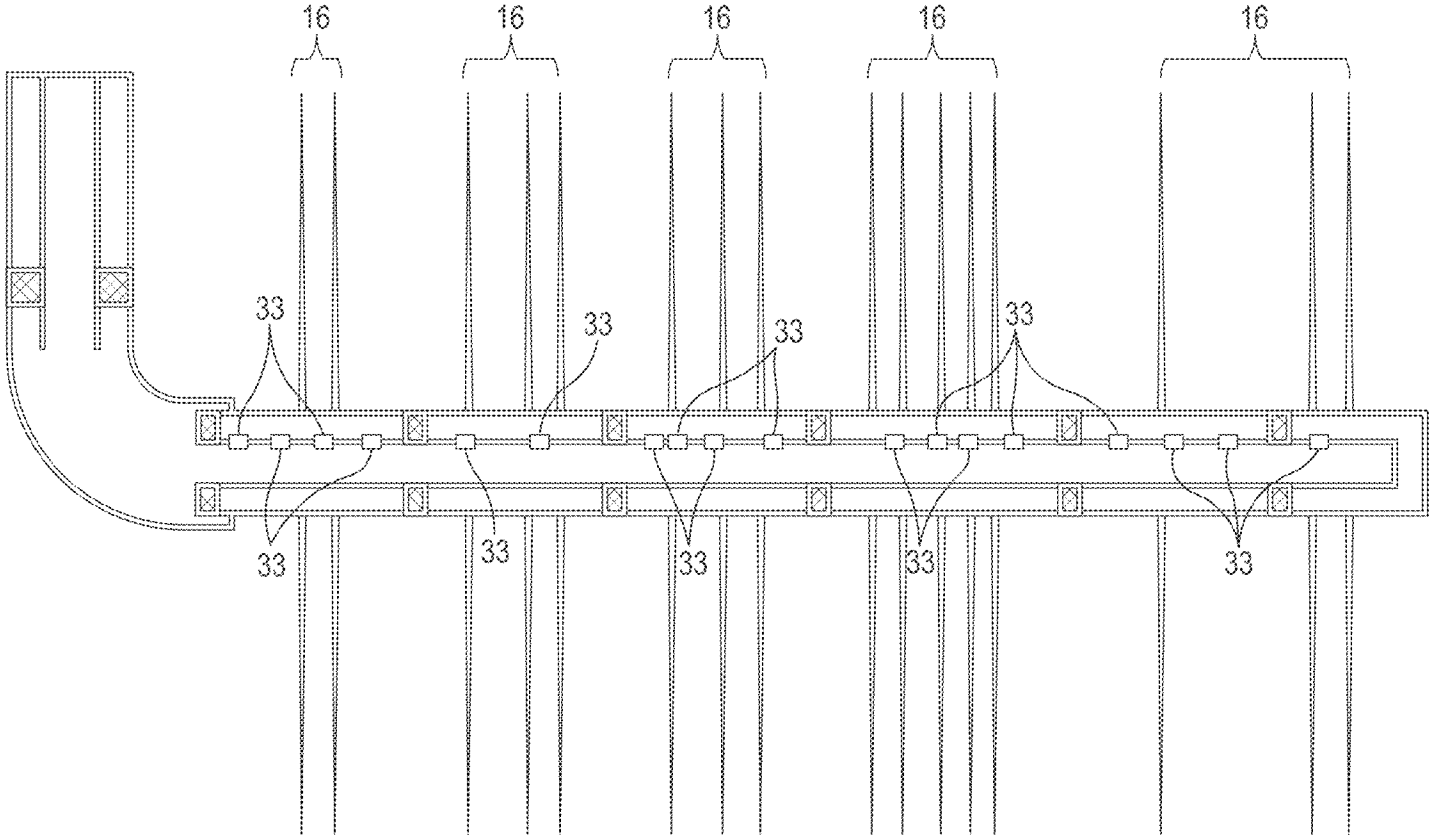
FIG. 2 is a schematic representation of a further system according to the disclosure.

FIG. 2 depicts a further example of the present disclosure. In FIG. 2, the system comprises a plurality of flow devices 33. Each of the flow devices 33 is configured to act as an outflow device and an inflow device. As such, the flow devices 33 have the properties of an outflow device as described herein when fluid is flowing through them from the injection flow path into the reservoir and the properties of an inflow device as described herein when fluid is flowing through them from the reservoir into the production flow path. Both of the injection flow path and the production flow path (not shown) are connected to each of the flow devices 33.

FIG. 3 depicts a section of a completion according to the disclosure. FIG. 3 schematically illustrates an injection flow path 28 and a production flow path 30 and how the outflow devices 32 and the inflow devices 34 allow fluid to flow out from and in to their respective flow paths.

The flow paths 28, 30 shown in FIG. 3 may be schematic in the case where the liner 18 acts as the conduit for both flow paths (i.e. independent tubing is not provided for each flow path 28, 30) or more literal in the case where each flow path comprises a conduit/tubing which is independent to that of the other flow path.

FIGS. 4 and 5 schematically illustrate the section of the system of FIG. 3 during use.

Once the well 12 has been drilled and lined with casing 14 and the fractures 16 have been induced, the completion is installed in the well 12 by locating the liner 18 within the casing 14 and engaging the packers 20 to isolate the separate regions of the well 12 and reservoir and hold the completion in place.

An initial production phase may be undertaken, during which oil is produced through the production flow path 30 to the surface.

After a period of time, the pressure in the reservoir and the production rate will drop, due to a reduction in the readily available oil in the reservoir. Once the pressure in the reservoir drops to a predetermined value, an enhanced oil recovery method may be employed as described herein.

Injection gas may be delivered into the reservoir via the injection flow path 30, as shown in FIG. 4. The injection gas (represented by the arrows in FIG. 4) may be hydrocarbon gas, carbon dioxide, nitrogen, steam or any other gas suitable for enhanced oil recovery methods. The injection gas is delivered from the surface and travels through tubing of the injection flow path 28 (which may be the liner 18 itself). The injection gas enters the annulus 24 via outflow devices 32. Once in the annulus, the injection gas diffuses into the reservoir, largely via the fractures 16.

The outflow devices 32 define the pressure at which the injection gas enters the annulus 24 (and thus the region of the reservoir). The pressure of the injection gas may vary across different regions 22 of the well 12 in order to be optimised for the geological properties of the formation in that region 22.

An enhanced oil recovery method according to the disclosure may then employ a soak period, during which time the well is effectively shut whereby there is no fluid flow in the liner 18 (for example by preventing fluid flow in the injection flow path and production flow path). This allows the injection gas to diffuse within the reservoir. The production of oil using the current method is largely based on the expansion of the oil and injection gas within the low-permeability formation. As such, allowing the injection gas a period of time in which to diffuse within the reservoir increases diffusion distances and will often increase oil production once production begins.

The required length of soak period will be dependent on the geological properties of the reservoir and the diffusion properties of the injection gas, among other things. Typical soak periods may last days or weeks.

Once the soak period has been completed, oil can be produced, as illustrated in FIG. 5.

Oil present in the formation (represented by the arrows in FIG. 5) will have expanded within the reservoir and, when the pressure within the production flow path 30 has been reduced to allow fluid flow therethrough, will enter the production flow path 30 via the fractures 16, the annulus 24 and inflow devices 34. The oil will then travel through the production flow path 32 and to the surface to be processed.

Figure 6:
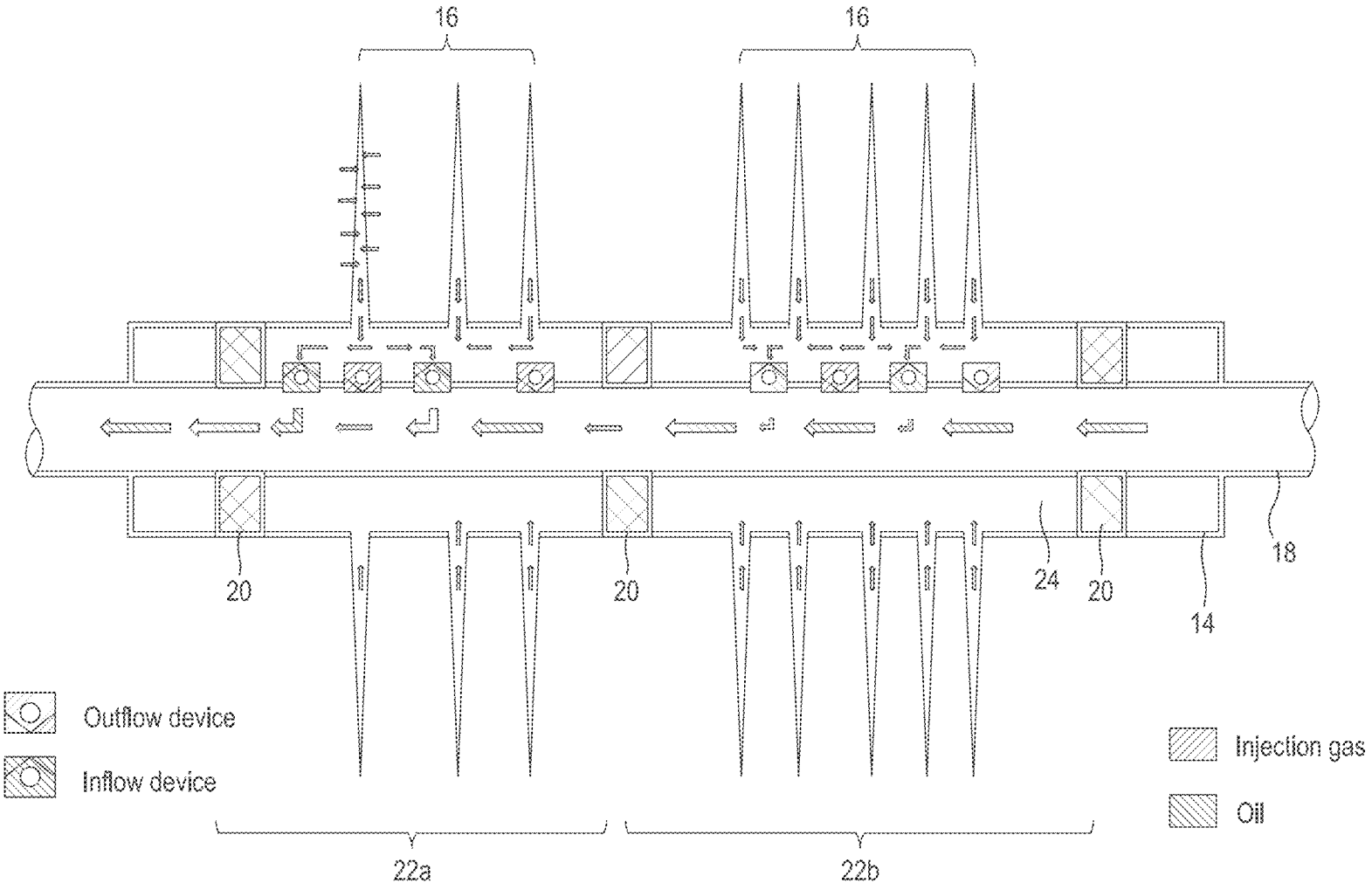
FIG. 6 is a schematic representation of the system of FIG. 3 during use.

Turning now to FIG. 6, a first region 22*a* of the reservoir is producing oil, which enters the production flow path 30 via the inflow devices 34 as described above. However, a second region of the reservoir 22*b* is not producing oil. Instead, the injection gas trapped in the reservoir is trying to enter the production flow path 30 through the inflow devices 34.

The inflow devices 34 are configured to selectively choke the flow rate of fluid through the inflow device based on the viscosity of the fluid. As the injection gas has a much lower viscosity than oil, the flow of injection gas through the inflow devices 34 in the second region 22*b* is choked. As such, the amount of injection gas which enters the production flow path 30 is much lower than it otherwise would be and the flow rate is much lower than that of the oil. Accordingly, more injection gas is left in the reservoir than would otherwise be the case and the average residence time is increased. This increase in residence time increases the diffusion within the reservoir and thus increases the recovery efficiency of the well 12.

In some examples according to the disclosure, the injection gas can be delivered into the reservoir via the injection flow path 28 at the same time as oil is produced via the production flow path 30. The operation of the two flow paths will be largely similar to that discussed above, since both flow paths can operate largely independently.

In an arrangement where the injection gas is delivered into the reservoir simultaneously with the production flow path 30 producing oil and choking the flow of injection gas, the outflow devices 32 and inflow devices 34 may be arranged in groups or banks of like devices. For example, there may be a section of the well (e.g, part of or multiple regions) comprising only outflow devices 32 and a section of the well (e.g. part of or multiple regions) comprising only inflow devices 34.

Figure 7:
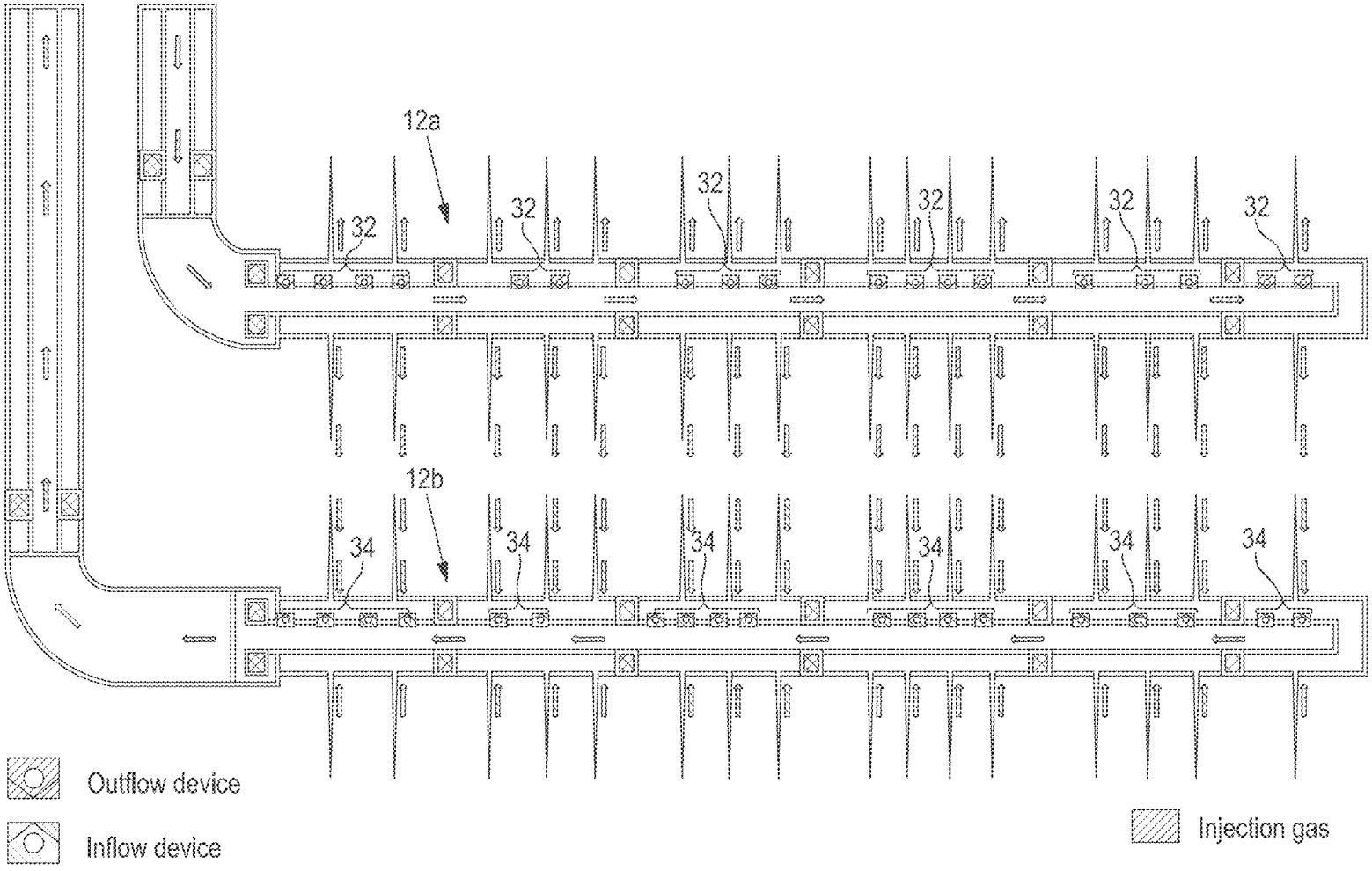
FIG. 7 is a schematic representation of a system according to the disclosure.

FIG. 7 illustrates an alternative system according to the disclosure. In FIG. 7 the injection flow path 28 and production flow path 30 are separated into different wells 12*a* 12*b*. The individual operation of the injection flow path 28 and production flow path 30 are as described above, the only difference being that the two flow paths are located in separate wells. The embodiment of FIG. 7 can be used for sequential "huff and puff" operation, in which injection gas is delivered to the reservoir, a soak period allows the injection gas to diffuse within the reservoir and then the production flow path 30 is opened (i.e. depressurised) such that oil can be produced therethrough.

Figure 8:
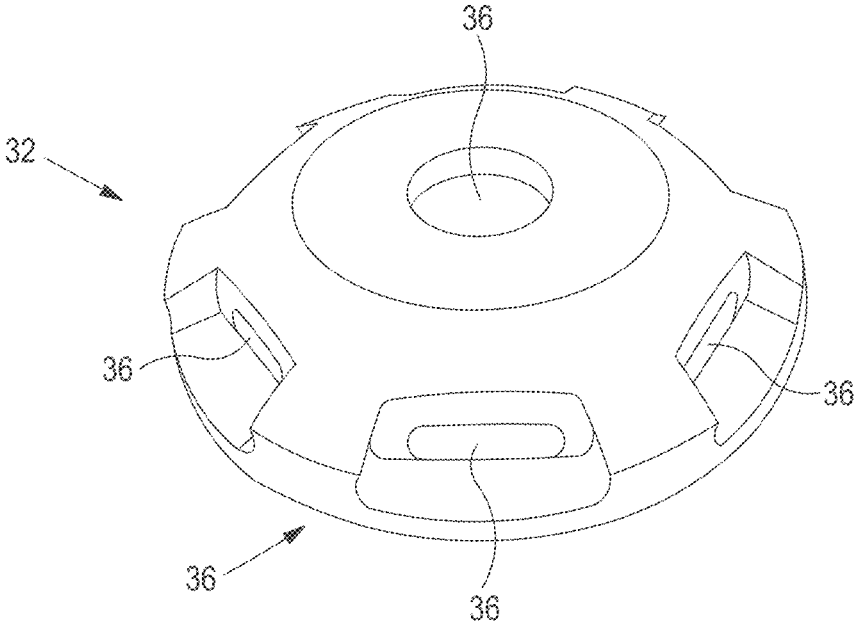
FIG. 8 is a schematic representation of an exemplar outflow device for use with a system according to the disclosure.

The embodiment of FIG. 7 can also be used in a simultaneous method, whereby delivering an injection gas through the injection flow path 28, producing oil from a plurality of regions of the subterranean reservoir through production flow path 30 and restricting flow of the injection gas into the production flow path 30 are undertaken simultaneously FIG. 8 illustrates an example of a suitable device for use as an outflow device 32. Fluid can flow through the device via ports 36 on the top, sides and underneath the device. The device comprises an internal cavity comprising a movable member which can act to restrict flow therethrough.

The illustrated device is an ICD and the illustrated example is the Tendeka FloSure Bypass Valve™ (http://www.tendeka.com/technologies/inflow-control/flosure-by-pass-valve/), although many other suitable examples exist and examples of the present disclosure are in no way limited to this specific device.

Figure 9:
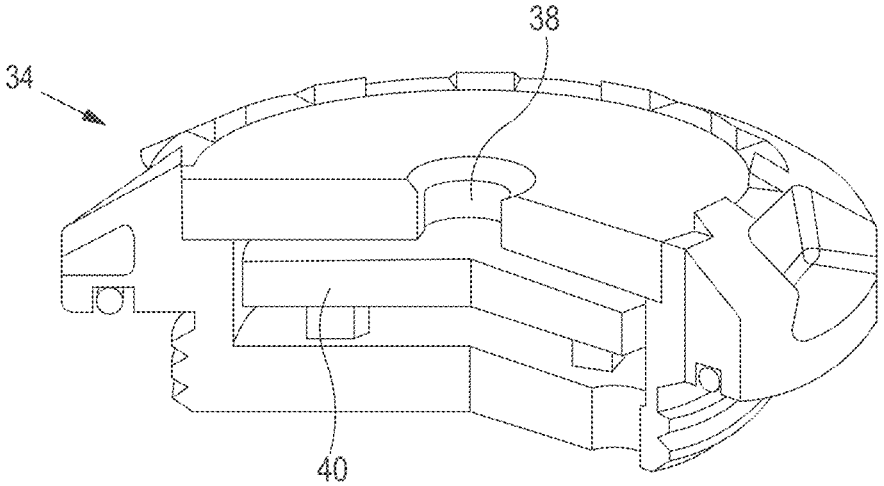
FIG. 9 is a schematic representation of an exemplar inflow device for use with a system according to the disclosure.

FIG. 9 illustrates an example of a suitable device for use as an inflow device 34. Fluid can flow through the device via ports 38 on the top and underneath the device. The device comprises an internal cavity comprising a movable member 40 which can act to restrict flow therethrough.

The illustrated device is an AICD and the illustrated example is the Tendeka FloSure™ AICD (http://www-.tendeka.com/technologies/inflow-control/flosure-aicd-screens/), although many other suitable examples exist and examples of the present disclosure are in no way limited to this specific device.

The present invention has been described above purely by way of example. Modifications in detail may be made to the present invention within the scope of the claims as appended hereto.

The invention claimed is:

1. A method for recovering oil from a subterranean reservoir, the method comprising:

delivering an injection gas through an injection flow path into a first region of the subterranean reservoir via a first outflow device arranged along the injection flow path, the first outflow device configured to provide a first pressure drop across the first outflow device;

delivering an injection gas through an injection flow path in to a second region of the subterranean reservoir via a second outflow device arranged along the injection flow path, the second outflow device configured to provide a second pressure drop across the second outflow device, wherein the first pressure drop and second pressure drop are different in order to suit the subterranean reservoir;

producing oil from a plurality of regions of the reservoir via a production flow path with a plurality of inflow devices arranged along the production flow path; and restricting flow of the injection gas into the production flow path from the reservoir by choking the flow of the injection gas through at least one of the plurality of inflow devices such that a residence time of the injection gas within the reservoir is increased.

2. A method according to claim 1, wherein the flow of the injection gas through at least one of the plurality of inflow devices is choked while oil is produced through at least one of the plurality of inflow devices.

3. A method according to claim 1, wherein restricting flow of the injection gas into the production flow path comprises selectively choking the flow of fluid through at least one of the plurality of inflow devices such that the flow of injection gas through the at least one of the plurality of inflow devices is choked more than the flow of oil.

4. A method according to claim 3, wherein the flow of fluid through the at least one of the plurality of inflow devices is selectively choked based on at least one of a viscosity of the fluid and a density of the fluid.

5. A method according to claim 1, wherein producing oil from a plurality of regions of the subterranean reservoir comprises an initial production phase before delivering injection gas and a subsequent production phase after delivering injection gas.

6. A method according to claim 1, wherein delivering an injection gas through an injection flow path, producing oil from a plurality of regions of the subterranean reservoir and restricting flow of the injection gas into the production flow path are undertaken simultaneously.

7. A method according to claim 1, wherein the injection flow path and the production flow path are in a single well.

8. A method according to claim 1, wherein the injection flow path is in a first well and the production flow path is in a second well.

9. A method according to claim 1, further comprising stopping all fluid flow in the injection flow path and the production flow path to control the residence time of the injection gas within the subterranean reservoir.

10. A system for recovering oil from a subterranean reservoir, the system comprising:

an injection flow path for delivering injection gas into a plurality of regions of a subterranean reservoir;

wherein the injection flow path comprises a plurality of outflow devices arranged along the injection flow path; wherein a first one of the plurality of outflow devices, located in a first region of the reservoir, is configured to provide a first pressure drop across the device; and a second one of the plurality of outflow devices, located in a second region of the reservoir, is configured to provide a second pressure drop, wherein the first pressure drop and second pressure drop are different in order to suit the subterranean reservoir;

a production flow path for producing oil from a plurality of regions of the subterranean reservoir;

wherein the production flow path comprises a plurality of inflow devices arranged along the production flow path;

wherein at least one of the plurality of inflow devices is configured to choke the flow of the injection gas into the production flow path from the reservoir such that a residence time of the injection gas within the subterranean reservoir is increased.

11. A system according to claim 10, wherein the plurality of inflow devices are configured to choke the flow of the injection gas into the production flow path in a first region of the reservoir while oil is produced from a second region of the reservoir via the production flow path.

12. A system according to claim 10, wherein at least one of the plurality of inflow devices is configured to selectively choke the flow of fluid such that the flow of injection gas through the inflow device is choked more than the flow of oil.

13. A system according to claim 12, wherein the at least one of the plurality of inflow devices is configured to selectively choke the flow of fluid therethrough based on at least one of a viscosity of the fluid and a density of the fluid.

14. A system according to any of claim 10, wherein the system is configured to simultaneously deliver injection gas through the injection flow path;

produce oil through the production flow path; and choke the flow of injection gas into the production flow path.

15. A system according to claim 10, wherein the injection flow path and production flow path are provided as part of a single completion apparatus for use in a single well.

16. A system according to claim 10, wherein:

the system comprises a first completion apparatus for use in a first well and a second completion apparatus for use in a second well located adjacent the first well;

the first completion apparatus comprises the injection flow path; and the second completion apparatus comprises the production flow path.

17. A system according to claim 10, wherein the system is configured to stop fluid flow in the injection flow path and the production flow path to control the residence time of the injection gas within the subterranean reservoir.

18. A system according to claim 10, wherein:

at least one of the outflow devices is configured to prevent fluid entering the injection flow path from the reservoir; and/or at least one of the inflow devices is configured to prevent fluid entering the reservoir via the production flow path.

19. A system according to claim 10, wherein at least one of the inflow devices is also an outflow device.

20. A method for recovering oil from a subterranean reservoir, the method comprising:

delivering an injection gas through an injection flow path into a plurality of regions of the subterranean reservoir via a plurality of outflow devices arranged along the injection flow path;

producing oil from a first region of the reservoir using one or more first inflow devices arranged along the production flow path, the first inflow devices configured to define a first pressure drop across the first inflow device;

producing oil from a second region of the reservoir using one or more second inflow devices arranged along the production flow path, configured to define a second pressure drop across the second inflow device, arranged along the production flow path, wherein the second pressure drop is different to the first pressure drop, in order to balance production across the subterranean reservoir; and restricting flow of the injection gas into the production flow path from the reservoir by choking the flow of the injection gas through at least one of the plurality of inflow devices such that a residence time of the injection gas within the reservoir is increased.

* * * * *